United States Patent [19]

Lamlee

[11] 4,200,298

[45] Apr. 29, 1980

[54] GAME BOARD AND GAME PIECES USEABLE THEREWITH

[76] Inventor: Stewart Lamlee, 55 W. 86th St., New York, N.Y. 10024

[21] Appl. No.: 917,545

[22] Filed: Jun. 21, 1978

[51] Int. Cl.[2] ..... A63F 3/00

[52] U.S. Cl. ..... 273/236; 273/266; 273/271

[58] Field of Search ..... 273/236, 242, 258, 261, 273/264, 267, 271, 273, 266

[56] References Cited

U.S. PATENT DOCUMENTS

| | | | |
|---|---|---|---|
| 830,288 | 9/1906 | Berberich | 273/261 |
| 970,070 | 9/1910 | Matthews | 273/264 |
| 1,388,505 | 8/1921 | Bamforth | 273/267 |

*Primary Examiner*—Anton O. Oechsle

*Attorney, Agent, or Firm*—Brian L. Ribando

[57] ABSTRACT

A game board comprises a plurality of adjacent irregularly shaped playing areas, each area having sides in common with at least three other areas. Each of two players, in alternate turns, places chips into areas which are unoccupied and which do not have a common side with an area which is already occupied by a chip belonging to the player then placing a new chip. When it is no longer possible for a player to place a chip according to the above rules, that player places his chip into an area which does have at least one side in common with an area which also contains his chip. After so placing a chip, the player removes his chips from all those areas which have a side in common with that area into which his chip has just been placed. The first player to have only one chip left on the board wins the game.

3 Claims, 1 Drawing Figure

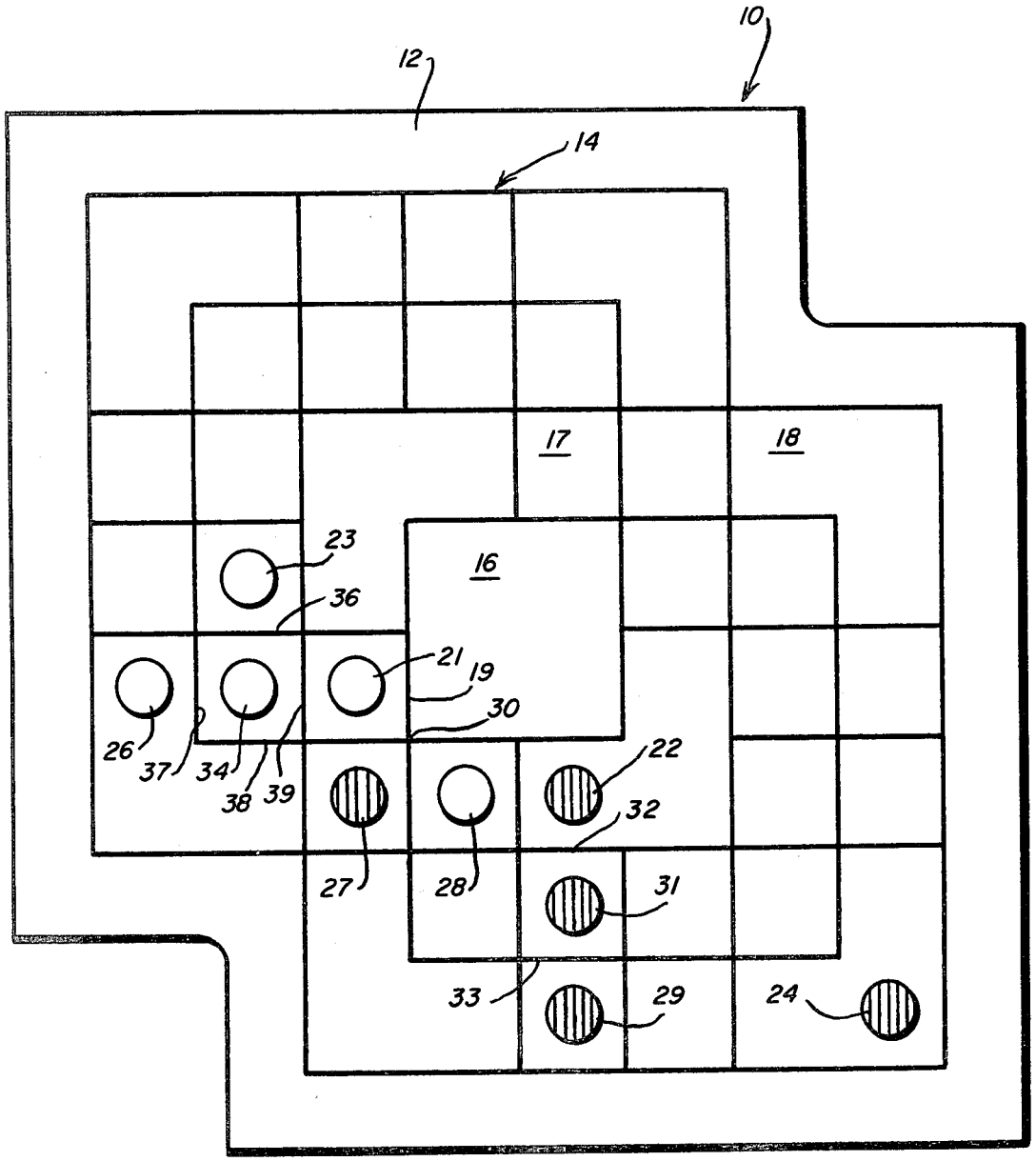
10
12
14
17
18
16
23
36
21
19
30
26
37
34
38
39
22
32
27
28
31
33
29
24

GAME BOARD AND GAME PIECES USEABLE THEREWITH

BACKGROUND OF THE INVENTION

The invention relates to a game for two players in which chips are first placed on a game board according to the first set of rules, and are thereafter removed from the board according to a second set of rules.

Game board type games for two or more players in which pieces are placed upon or moved about the surface of a game board are well known in the prior art. The various games which have been developed each follow a unique set of rules and are designed to provide entertainment and a challenge to the participants. The present invention is directed to a game board and pieces which are useable therewith, and to a game which may be played thereon. Since the rules of the game are relatively simple to master, the game is suitable for play by children. Since a great deal of strategy may be employed in the playing of the game, the game provides a challenge for adults.

SUMMARY AND OBJECTS OF THE INVENTION

According to the invention, the game board is divided into a plurality of discrete playing areas. Each area has at least three sides in common with adjacent playing areas. Each player in turn puts a chip into any of the playing areas on the board which are unoccupied by another chip and which do not have a common side with another area already having a chip belonging to the player. When it is no longer possible for the players to place chips on the board according to the above rule, that player then places his chip on the board in a playing area which unoccupied by another chip but which does have at least one side in common with a playing area already having that player's chip therein. That player then removes all of his chips in playing areas having a common side with the playing area containing the newly placed chip. This newly placed chip remains on the board. The process of placing and removing chips continues until one of the players has only one chip left on the board. That player wins the game.

It is therefore an object of the invention to provide a game apparatus comprising a game board and a plurality of chips.

It is another object of the invention to provide a game apparatus comprising a board of a plurality of irregularly shaped contiguous areas and a plurality of chips of two colors comprising two chip sets.

It is another object of the invention to provide a game apparatus comprising a board of irregularly shaped playing areas contiguous with one another and two sets of chips to be used by two players alternately, which chips are first placed upon the board and then removed according to predetermined rules.

These and other objects of the invention will become apparent from the following detailed description taken in conjunction with the accompanying drawing figure.

BRIEF DESCRIPTION OF THE DRAWING

The single drawing FIGURE shows a game board with a plurality of chips in position thereon.

DESCRIPTION OF THE PREFERRED EMBODIMENT

Referring now to the drawing, there is shown in the single drawing FIGURE a game board generally designated by the reference numeral 10. The board comprises a marginal portion 12 which extends around the periphery thereof and surrounds a plurality of playing areas collectively designated 14. The playing areas 14 comprise a square area 16 having a first size, square areas 17 having a second size, and right angle shaped areas 18. It should be understood that other shapes such as rectangles, triangles, trapezoids, parallelograms, or other closed figures having straight or curved sides may be employed. However, the playing areas should be arranged so that every playing area has at least three sides in common with adjacent playing areas.

A game which may be played on the board of the instant invention involves two players, each player having a supply of chips of a certain color which is a different color than a supply of chips used by the other player. Each player in turn puts one of his chips in any of the playing areas on the game board which is unoccupied by another chip, and which does not have a common side with another playing area already having a chip of the same color therein.

A typical game between a first player and a second player may be begun by the first player placing a chip 21 as shown. The second player may then place his chip 22 as shown. The first player may then place a chip in any unoccupied playing area which does not have a side in common with the playing area in which the chip 21 has been placed. As an illustration, the first player may place a second chip 23 as shown, but may not place a chip in the large central square 16, since the square 16 includes a side 19 which is common with the playing area containing the chip 21. The second player may then place a chip in any unoccupied playing area which does not have a side in common with the playing area in which the chip 22 has been placed. For instance, the second player may place a chip 24 as shown. Additional chips 26, 27, 28, and 29 may then be placed alternately by the two players according to the rules of the game. It should be noted that the playing areas containing chips 21 and 28 are contiguous only at point 30 and are not considered to have a common side. Further chips may be placed on the board until it is no longer possible for a player to place a chip upon the board in an unoccupied playing area which does not have a side in common with an adjacent playing area already having his own chips therein. At this point in the game, new rules of play come into effect.

The player who is no longer able to place a chip in accordance with the original rules of play, now must place his chip in a playing area which is unoccupied, but which has at least one side in common with a playing area already having his own chip therein. For example, the second player may place a chip 31 as shown. The playing area in which the chip 31 is placed has sides 32 and 33 in common with those playing areas already containing his chips 29 and 22. After placement of chip 31 on the board, the second player removes the chips 29 and 22 and allows the chip 31 to remain. The first player may now place a chip 34 on the board. The playing area in which the chip 34 is placed has sides 36, 37, 38, and 39 in common with those playing areas containing chips 21, 23, and 26. After placement of chip 32, the chips 21, 23, and 26 are removed from the board and the chip 32 remains. This type of play continues until one of the players has only one chip left on the board. That player wins the game.

It will be appreciated that while the rules of the game described herein are relatively easy to comprehend, that game play often leads to interesting strategies being developed. The pattern in which the chips are placed on the board during the first half of the game will determine how quickly those chips can be removed during the second part of the game. Different game patterns may be developed through the use of game boards having a playing area pattern which differs from that shown as described herein. Also, more than two players may play the game in which case more than two sets of chips would be required. On a game board designed for play by three or more players, a greater number of playing areas could be advantageously employed.

While various alterations and modifications of the game apparatus as described will occur to those skilled in the art, those modifications and alterations are considered to be within the scope of the present invention as defined in the appended claims.

I claim:

1. A game apparatus for two or more players, the apparatus comprising:

a game board consisting of a pattern of equal value playing areas and a blank marginal portion thereearound, the pattern having an outer perimeter consisting of eight right angle corners connected to one another, and the playing areas consisting of a single large square, a plurality of small squares, and a plurality of right angle figures, each playing area having at least three sides in common with at least three other contiguous playing areas, six right angle figures comprising six of said right angle corners and the tangency of four of said six right angle figures forming the remaining two of said right angle corners, and two sets of chips, the chips of one set being colored differently than the chips of the other set, wherein no more than one chip may occupy a single playing area at one time.

2. The game of claim 1 wherein the playing areas comprise a first area having a first shape and a first size and a plurality of second areas having said first shape and a second size.

3. The game of claim 2 wherein said pattern of playing areas is such that said playing areas, counted in any straight line across said game board, from one side to an opposite side, will total at least four.

* * * * *